US006705896B1

(12) United States Patent
Chang et al.

(10) Patent No.: US 6,705,896 B1
(45) Date of Patent: Mar. 16, 2004

(54) MICRO COAXIAL CABLE END CONNECTOR ASSEMBLY

(75) Inventors: Shih Tung Chang, Tu-Chen (TW); Chin Pao Kuo, Tu-chen (TW); Yun Long Ke, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/346,028

(22) Filed: Jan. 15, 2003

(51) Int. Cl.[7] ..... H01R 9/03
(52) U.S. Cl. ..... 439/610; 439/452; 439/98
(58) Field of Search ..... 439/610, 607, 439/609, 95, 98, 101, 108, 452, 449, 456, 579, 701

(56) References Cited

U.S. PATENT DOCUMENTS 3,487,160 A * 12/1969 Johnsen ..... 439/452
4,070,083 A * 1/1978 DiPalma ..... 439/452
D444,130 S * 6/2001 Hayashi et al. ..... D13/147
6,273,753 B1 * 8/2001 Ko ..... 439/607
6,305,978 B1 * 10/2001 Ko et al. ..... 439/610
6,338,652 B1 * 1/2002 Ko ..... 439/579
D456,777 S * 5/2002 Igarashi ..... D13/147
D456,779 S * 5/2002 Igarashi ..... D13/147
D456,780 S * 5/2002 Igarashi ..... D13/147
D457,138 S * 5/2002 Igarashi ..... D13/147

* cited by examiner

*Primary Examiner*—Renee Luebke
*Assistant Examiner*—Felix O. Figueroa
(74) *Attorney, Agent, or Firm*—Wei Te Chung

(57) ABSTRACT

An electrical connector assembly (100) including an electrical connector (1) and a cable (40). The electrical connector has a contact set (2) and a shield (30) enclosing the contact set. The contact set has an insulative insert (21) and a plurality of contacts (22) received in the insert. Each conductive contact has a mating portion (224) and a connecting portion (226) retained in a rear end of the insulative insert. The cable has a plurality of wires (41) and a pair of strong grounding conductors (42). Each wire has a conductive conductor electrically and mechanically connecting with the connecting portion of the contact. The pair of strong grounding conductors is mechanically connected to a pair of sides of the connector and electrically connected with a grounding trace of the connector so as to enhance a mechanical connection between the cable and the connector and a grounding effect.

9 Claims, 10 Drawing Sheets

MICRO COAXIAL CABLE END CONNECTOR ASSEMBLY

CROSS-REFERENCE TO RELATED APPLICATION

This patent application is a co-pending application of U.S. patent application Ser. No. 10/199,713, filed on Jul. 19, 2002, invented by David Tso-Chin Ko, entitled "MICRO COAXIAL CABEL CONNECTOR HAVING LATCHES FOR SECURELY ENGAGING WITH A COMPLEMENTARY CONNECTOR" and all assigned to the same assignee as this patent application.

BACKGROUND OF THE INVENTION

1. Field of the Invention

The present invention relates to a micro coaxial cable end connector assembly used in liquid crystal display (LCD) application, and particularly to such connector assembly having securely connection between a connector and a cable.

2. Description of Related Art

U.S. Pat. Nos. 6,305,978 B1, 6,273,753 B1, 6,338,652 B1, D456,779 S, D456,780 S, D456,777 S, D457,138 S, and D444,130 S disclose low profiled micro coaxial cable connector assembly. This type connector assembly comprises a micro coaxial connector and a cable connecting with the micro coaxial connector used to transmit signals between a mother board in a base of a notebook computer and an LCD panel of the notebook computer. Because the micro coaxial connector has a low profile configuration, the connector is not easy to be held and extracted from a complementary connector by a user's hand. In addition, when the micro coaxial cable connector assembly is assembled to the notebook computer, a lot of other electrical connectors are settled around the micro coaxial cable connector assembly so that the micro coaxial cable connector is not easy to be extracted because of the space limiting. Therefore, the user usually directly pulls the cable of the assembly so as to separate it from the complementary connector which may cause a disconnection between the cable and the connector. The signal transmission between the cable and the connector is effected.

Referring to FIG. 9, a micro coaxial cable connector assembly comprises a micro coaxial cable connector 2 and a cable 6 which has a plurality of wires 61 extending out the cable and connecting with the connector. The wires 61 are soldered with conductive contacts of the connector 2 and some adhesive is filled into the connector to further connect the contacts with the wires. When the cable is pulled, the wires arranged in the middle bear a little pull force and the wires arranged adjacent to a pair of sides of the connector bear a large pull force. Therefore, the wires arranged adjacent to the pair of sides of the connector are easy to be break so as to effect signal transmission.

It is desired to provide a new micro coaxial cable connector assembly having a secure connection between the connector and the wires of the cable.

SUMMARY OF THE INVENTION

Accordingly, one object of the present invention is to provide a micro coaxial cable connector assembly having a secure connection between a micro coaxial connector and wires of the cable.

In order to achieve the object set forth, an electrical connector assembly comprises an electrical connector and a cable. The electrical connector has a contact set and a shield enclosing the contact set. The contact set has an insulative insert and a plurality of contacts. The insulative insert defines a plurality of channels, the contacts are received into the channels and each conductive contact has a mating portion adapted for mating with a complementary connector and a connecting portion retained in a rear end of the insulative insert. The cable has a plurality of wires and a pair of strong grounding conductors. Each wire has a conductive conductor electrically and mechanically connecting with the connecting portion of the contact. The pair of strong grounding conductors is mechanically connected to a pair of sides of the connector and electrically connected with a grounding trace of the connector so as to enhance a mechanical connection between the cable and the connector and a grounding effect.

DETAILED DESCRIPTION OF THE INVENTION

Figure 1:
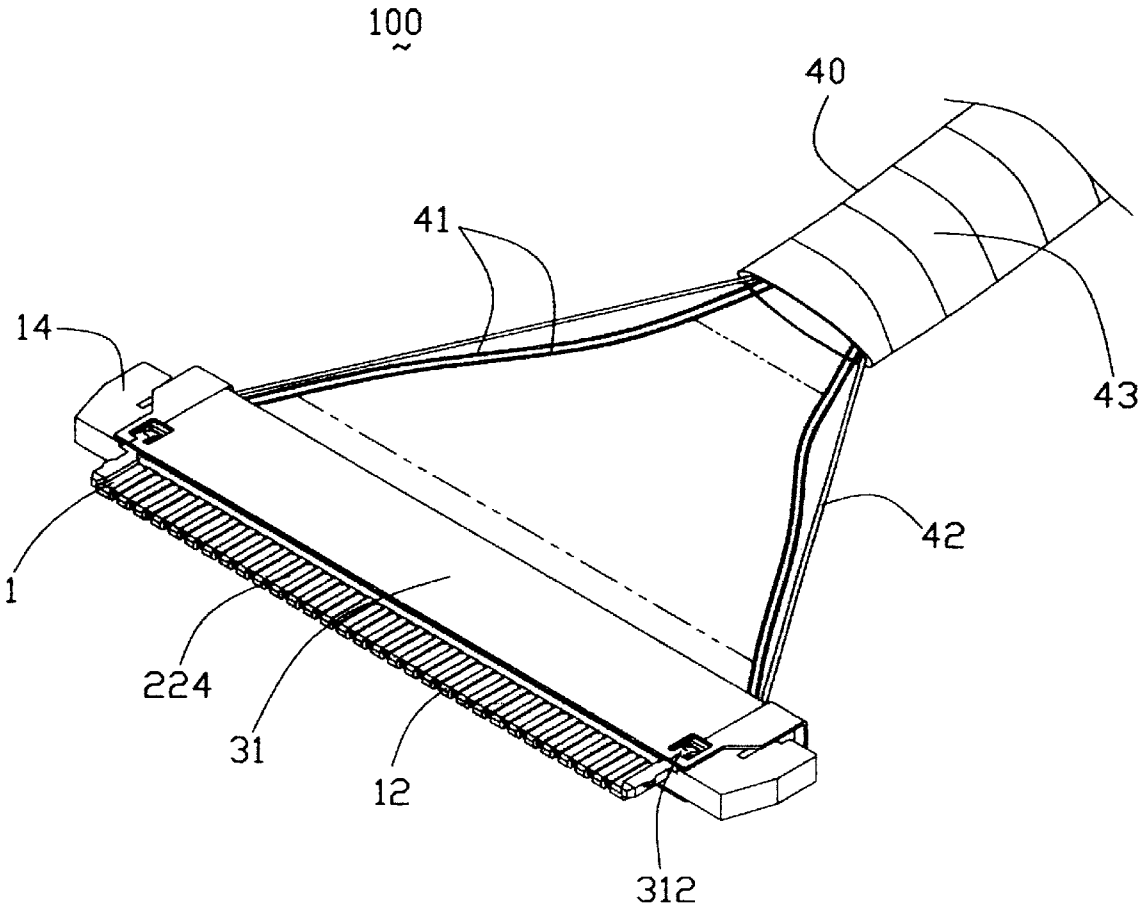
FIG. 1 is a perspective view of a micro coaxial cable connector assembly in accordance with the present invention.
Figure 2:
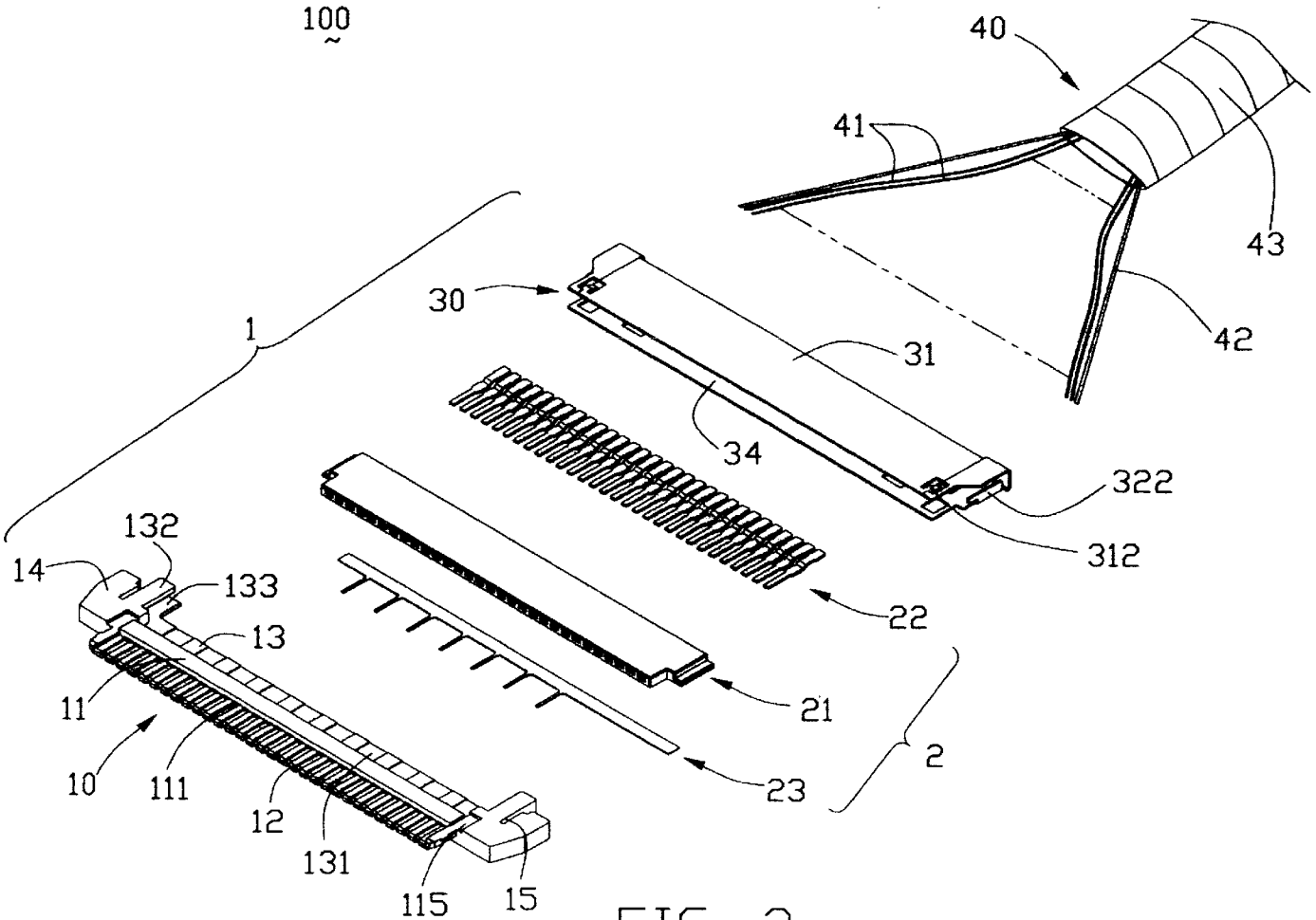
FIG. 2 is an exploded view of the micro coaxial cable connector assembly of FIG. 1.
Figure 3:
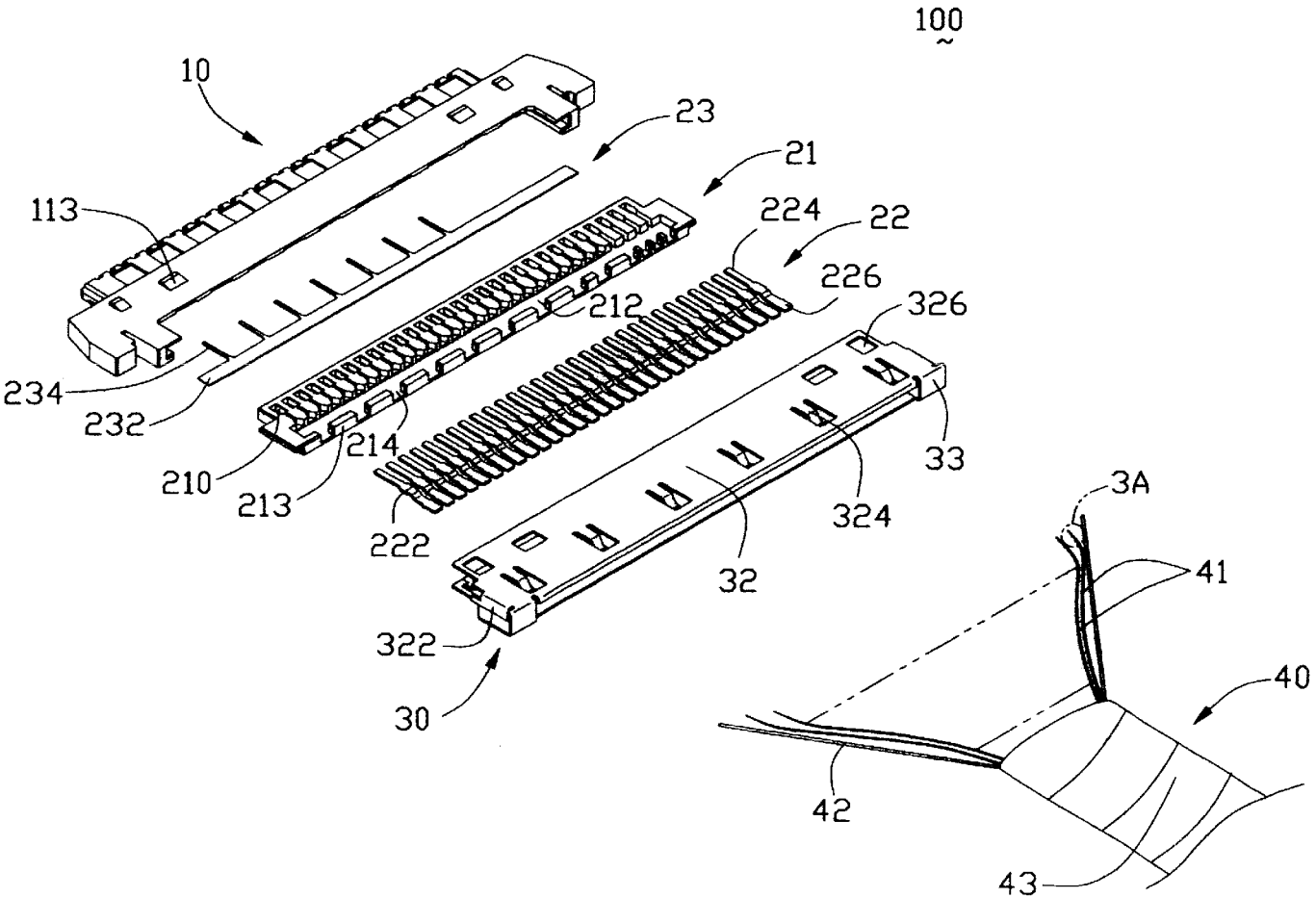
FIG. 3 is a view similar to FIG. 2, from a different aspect.

Referring to FIGS. 1, 2 and 3, a micro coaxial cable connector assembly 100 of the present invention comprises a micro coaxial connector 1 and a cable 40. The connector 1 comprises an elongate insulative housing 10, a contact set 2, and a conductive shield 30.

The insulative housing 10 comprises an elongate base portion 11, a tongue portion 12 extending forwardly from the base portion 11, a rear portion 13 at a rear end of the base portion 11, a pair of retention portions 14 formed on a pair of lateral ends of the base portion 11. The base portion 11 and the tongue portion 12 together define a plurality of passageways 111 from the rear end of the base portion 11 to a front end of the tongue portion 12. The rear portion 13 comprises an elongate plate 131 extending rearwardly from the base portion 11, a pair of receiving sections 132 formed on lateral ends of the elongate plate 131. Each of the receiving sections 132 defines a receiving channel 133 in an inner side thereof. A gap 15 is defined between each retention portion 14 and a corresponding receiving section 132. A plurality of protrusions 113 is formed on a bottom face of the base portion 11. A pair of recesses 115 is defined in an upper surface face of the base portion 11 adjacent to the retention portions 14.

The contact set 2 comprises an insulative insert 21, a plurality of signal and grounding contacts 22, and a grounding bar 23.

The insulative insert 21 defines a plurality of channels 210 adjacent to a front end thereof, a receiving groove 212 adjacent to a rear end thereof. The channels 210 communicate with the receiving groove 212. The channels 210 are extended in a front-to-rear direction. The receiving groove 212 is laterally extended. A plurality of slots 214 extends through a rear face 213 of the insert 21 and communicates with the receiving groove 212. The slots 214 are used to allow a plurality of wires 41 of a cable 40 extending therethrough into the receiving groove 212 and the channels 210.

The signal and grounding contacts 22 have the same structure; each contact 22 comprises a retention portion 222, a mating portion 224 extending forwardly from the retention portion 222, and a connecting portion 226 extending rearwardly from the retention portion 222. The mating portions 224 are for electrically engaging with the complementary connector. The connecting portions 226 are for electrically connecting with the wires 41 of the cable 40.

The grounding bar 23 comprises an elongate, laterally extending main portion 232 and a plurality of grounding fingers 234 extending forwardly from the main portion 232.

The conductive shield 30 comprises an upper plate 31, a lower plate 32, and a pair of connecting portions 33 connecting rear portions of the upper plate 31 and the lower plate 32. A receiving space 34 is defined between the upper and the lower plates 31 and 32. A pair of side portions 322 extends from a pair of lateral ends of the lower plate 32 to the upper plate 31. A plurality of resilient tabs 324 extends from the lower plate 32 into the receiving space 34 and a plurality of apertures 326 is defined in the lower plate 32. A pair of resilient bars 312 extends from the upper plate 31 into the receiving space 34.

Figure 3A:
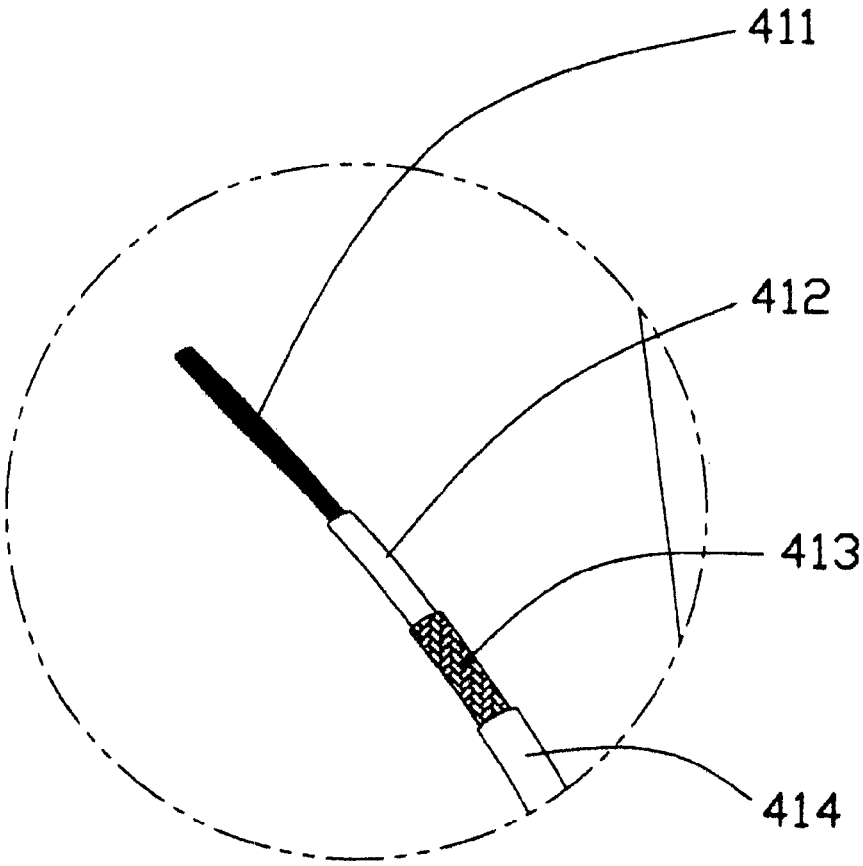
FIG. 3A is an enlarged perspective view of a skinned wire shown in FIG. 3.

Referring to FIGS. 2, 3 and 3A, the cable 40 comprises the plurality of wires 41, a pair of grounding conductors 42, and a conductive tape 43 wrapping around the wires 41 and grounding conductor 42. The wire 41 has a skinned end which has a center conductor 411, an insulator 412 enclosing the center conductor 411, a metal braiding 413 enclosing the insulator 412, and a insulative jacket 414 enclosing the metal braiding 413.

Figure 4:
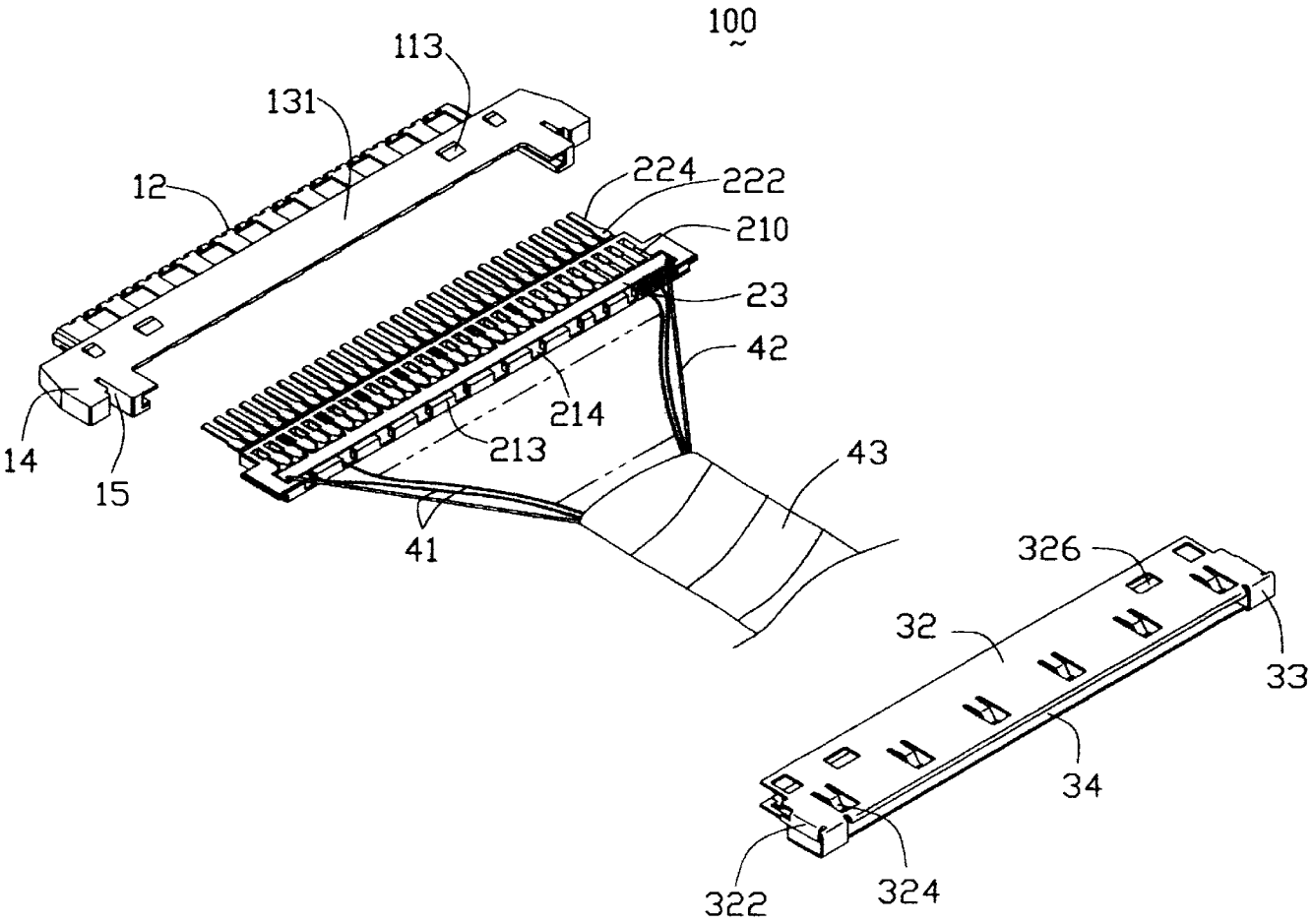
FIG. 4 is a partly assembled view of FIG. 3 showing an insulative housing and a shield without assembled.

Referring to FIG. 4, in assembly, the signal and grounding contacts 22 are respectively inserted into the channels 210 with the connecting portions 226 of the contacts 22 received in the channels 210, and the retention portions 222 and the mating portions 224 extending forwardly beyond a front face of the insert 21. The grounding bar 23 is inserted into the receiving groove 212 with the grounding fingers 234 extending into corresponding channels 210 to electrically contact the grounding contacts of the contacts 22. Therefore, the contact set 2 is assembled together. The cable 40 is assembled to the contact set 2 with the center conductors 411 of the wires 41 soldered to corresponding signal contacts and the metal braidings 413 of the wires 41 electrically and mechanically connecting with the grounding bar 23, and the grounding conductors 42 soldered to the main portion 232 of the grounding bar 23.

Figure 5:
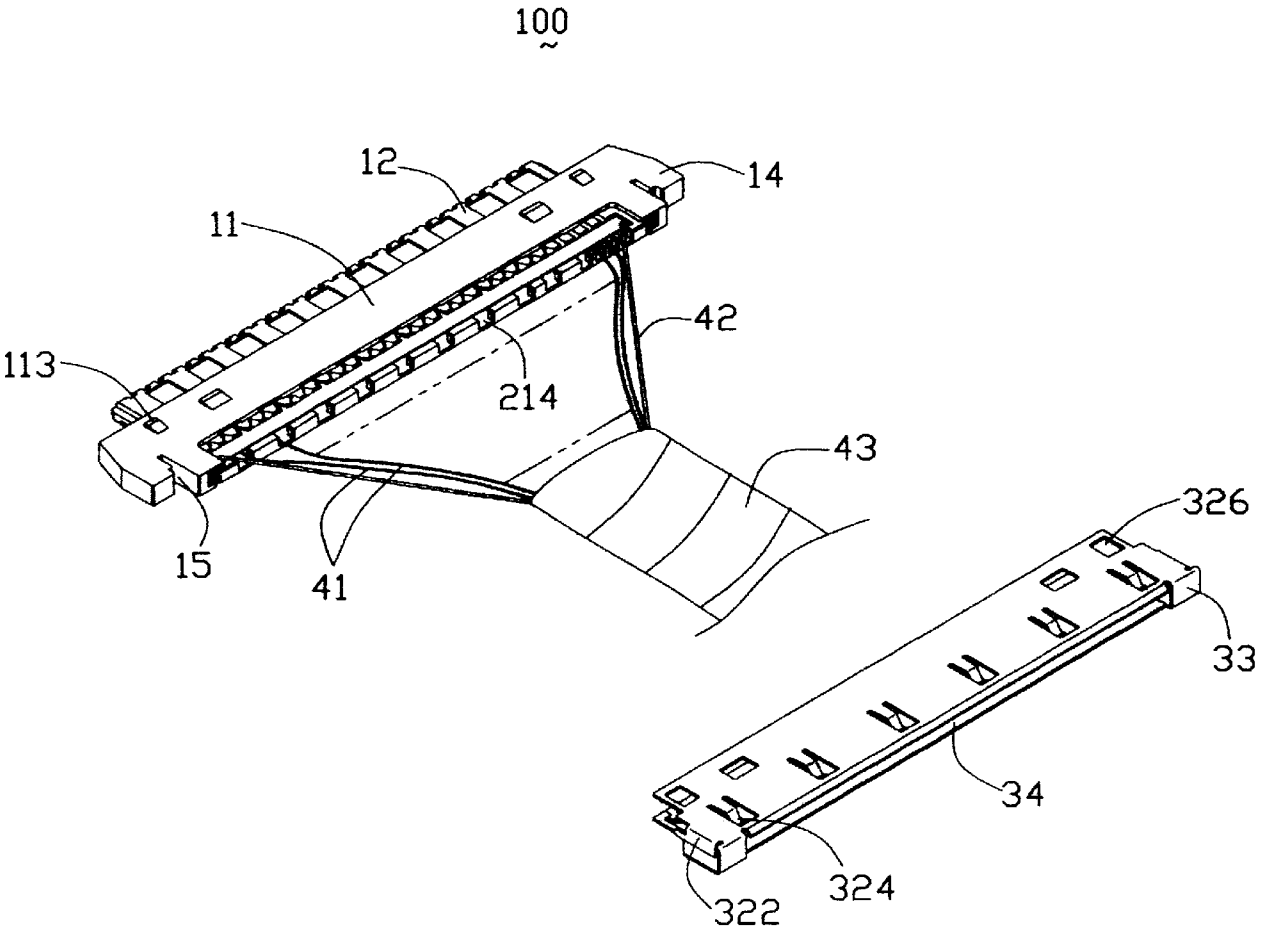
FIG. 5 is a partly assembled view of FIG. 4 showing the shield without assembled.

Referring to FIGS. 4 and 5, the contact set 2 is assembled to the elongate plate 131 of the rear portion 13 of the insulative housing 10 with lateral ends of the contact set 2 received in the receiving channels 133 of the receiving sections 132, respectively, and the retention portions 222 and the mating portions 224 of the contacts 22 extending into the passageways 111 of the housing 10, wherein the retention portions have an interferential fit with the housing 10.

Figure 6:
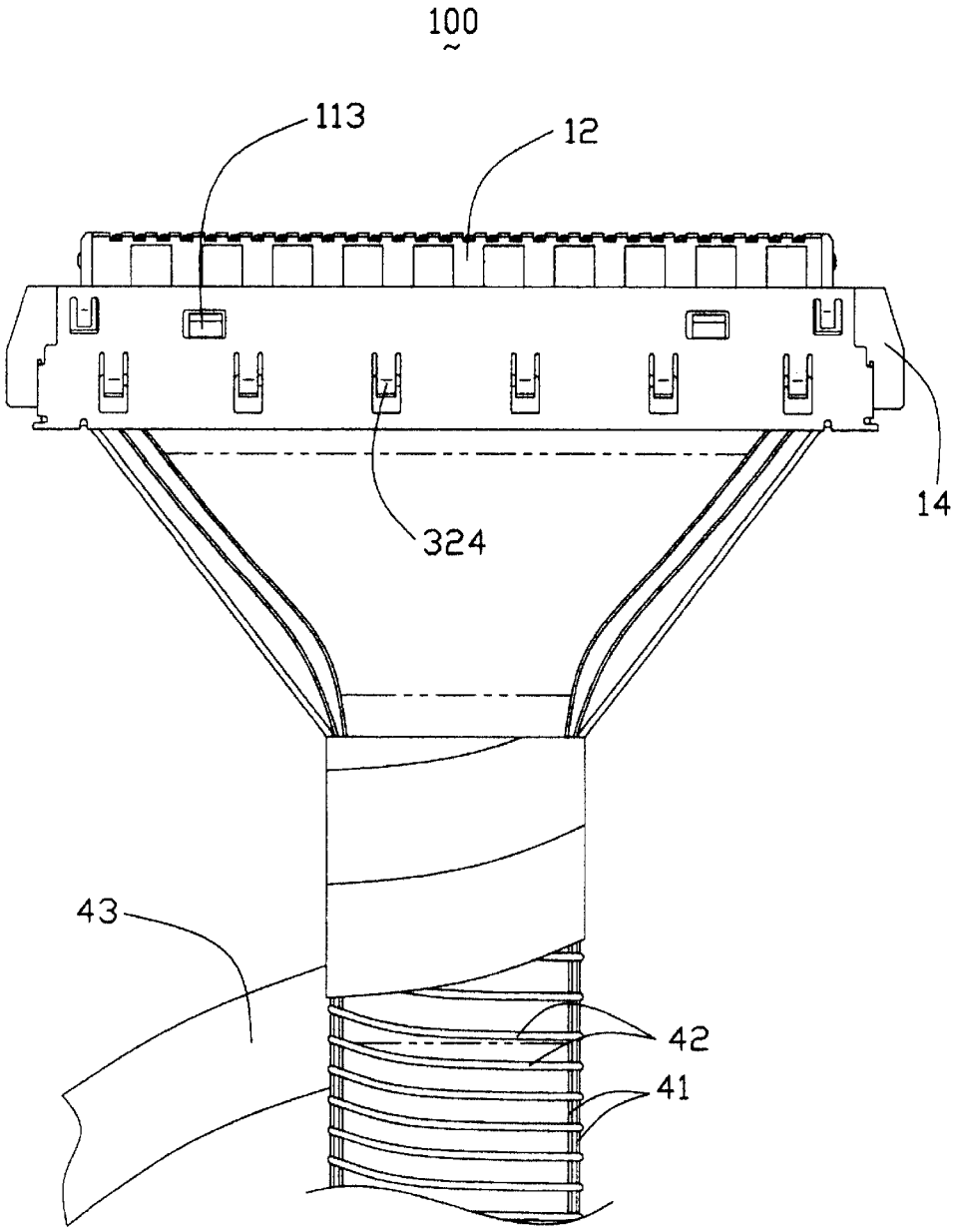
FIG. 6 is a further assembled view of FIG. 5 showing a pair of grounding conductors twisting around wires.

Referring to FIGS. 1, 5 and 6, the housing 10 is assembled into the receiving space 34 of the shield 3 with the plurality of protrusions 113 fitted into the apertures 326, the resilient tabs 324 extending into the receiving groove 212 and engaging with the grounding bar 23, and the resilient bars 312 engaging in the recesses 115 of the base portion 11 of the housing 1. The side portions 322 extend into and are securely retained in the gaps 15. Thus, the insulative housing 10, the contact set 2 and the shield 3 are assembled together.

Referring to FIG. 6, free ends of the pair of grounding conductors 42 soldered to the grounding bar 23 twist around the wires 41 so as enhance the intensity of tension of the cable 40. The conductive tape 43 wraps the wires 41 and the grounding conductors 42 therein with the grounding conductors 42 electrically connecting with conductive tape 43. Accordingly, the micro coaxial cable connector assembly 100 in accordance with the present invention is completed.

Figure 7:
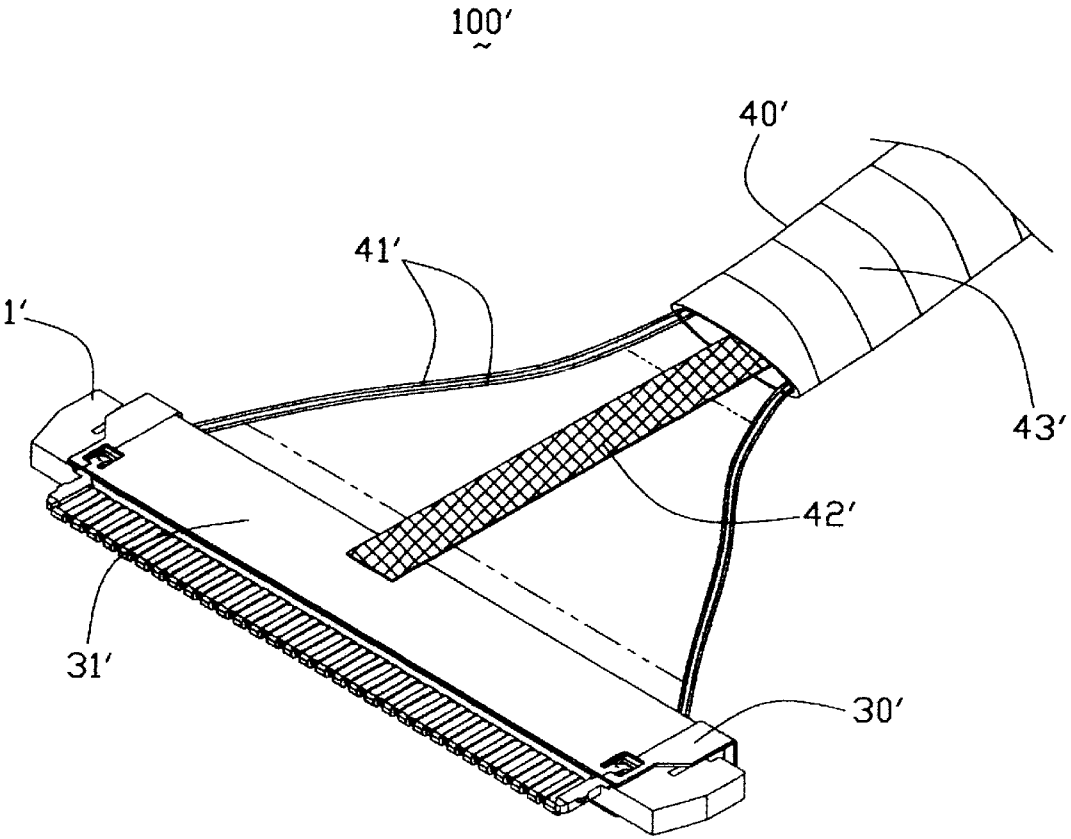
FIG. 7 is an assembled view of a second embodiment of a micro coaxial cable connector assembly showing a metal braiding connected to a shield.
Figure 8:
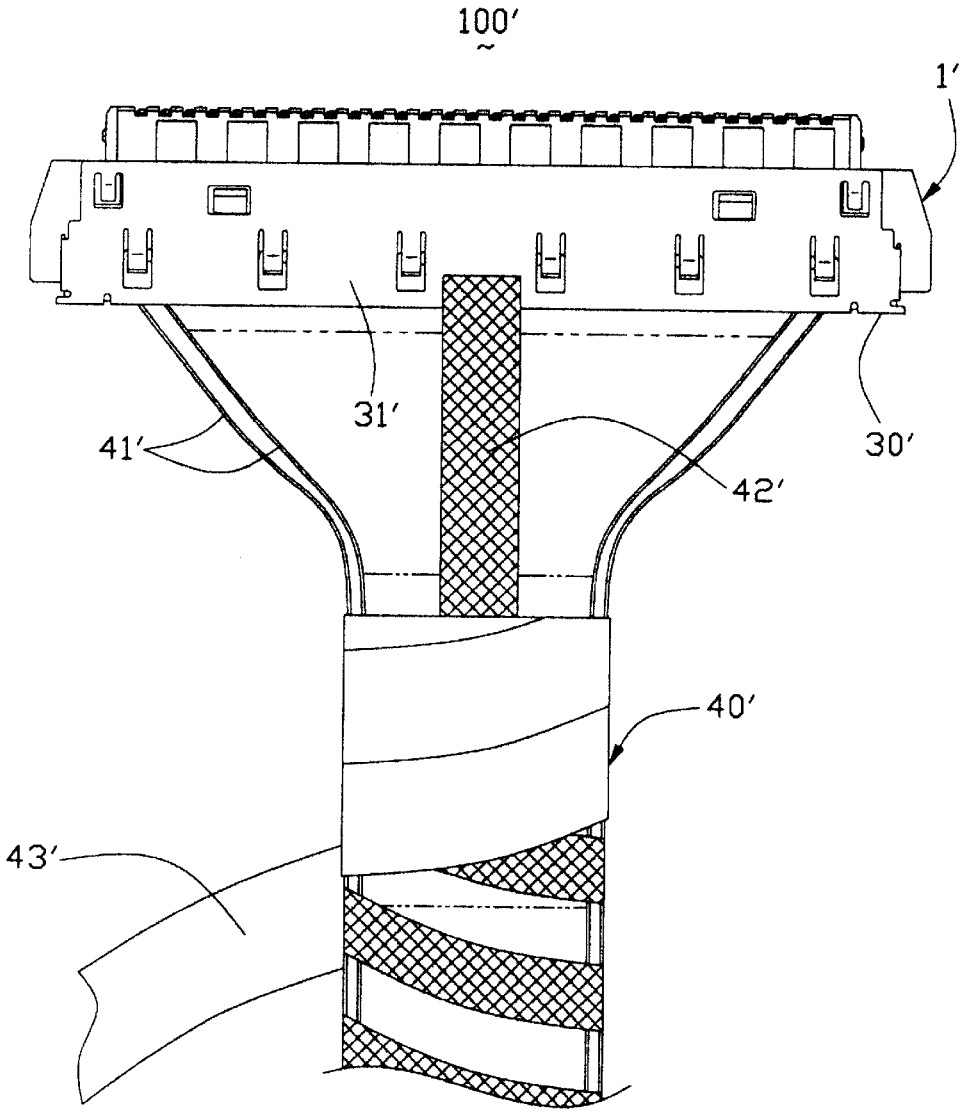
FIG. 8 is an assembled view similar to FIG. 7 showing the metal braiding twisting around wires.
Figure 9:
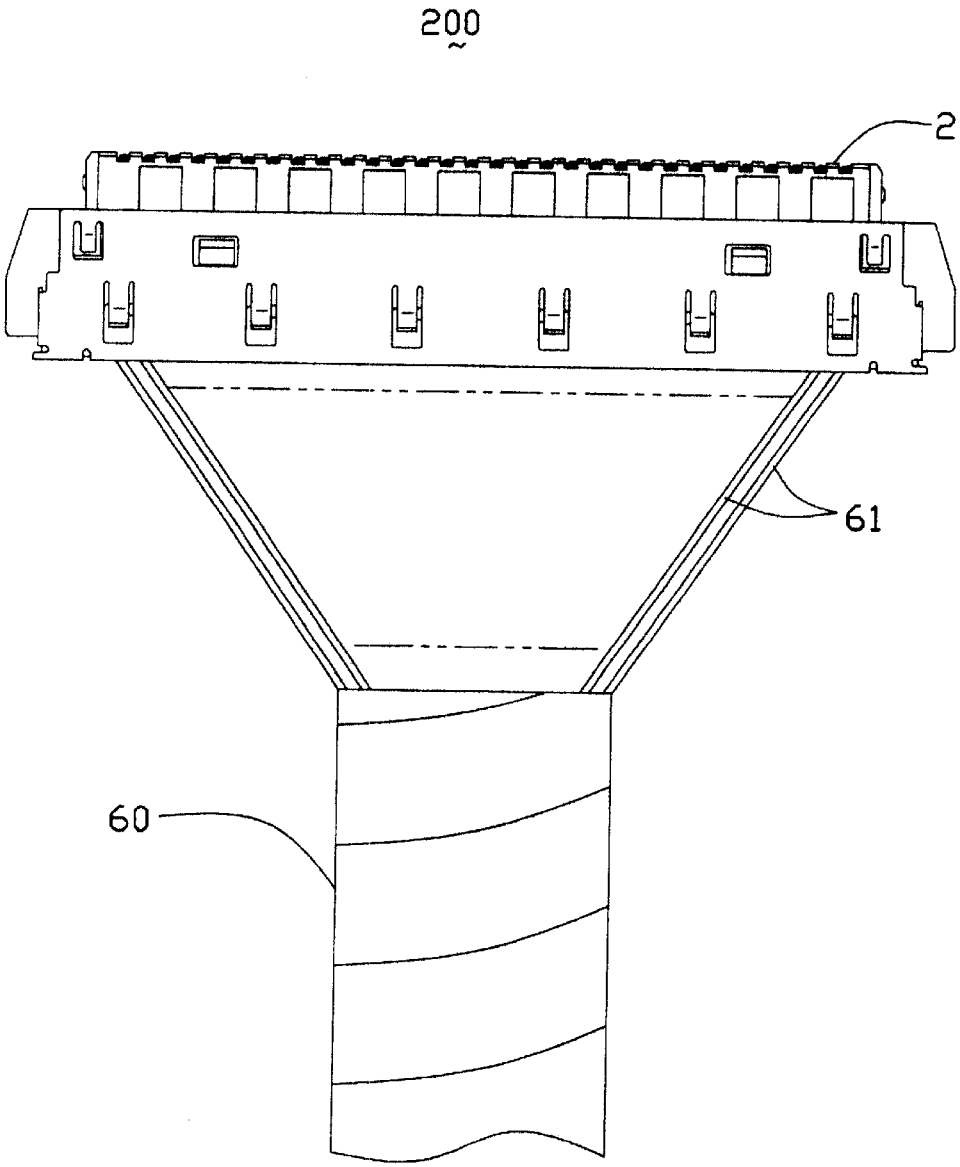
FIG. 9 (PRIOR ART)
FIG. 9 is an assembled view of a conventional micro coaxial cable connector assembly.

Referring to FIGS. 7 and 8, a micro coaxial cable connector assembly 100' of a second embodiment of the present invention comprising a micro coaxial connector 1' and a cable 40'. The cable 40' comprises a plurality of wires 41', a metal braiding 42' and a conductive tape 43'. One end of the metal braiding 42' is soldered to an upper plate 31' of a shield 30' and a free end of the metal braiding 42' twists around the wires 41' so as to enhance the intensity of tension of the cable. Finally, the conductive tape 43' wraps the wires 41' and the metal braiding 42' therein and the conductive tape 43' electrically connects with the metal braiding 42'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly adapted for mating with a complementary connector, comprising:

an electrical connector having a contact set, the contact set having an insulative insert, a plurality of channels defined in the insulative insert, a plurality of conductive contacts received into the channels and each conductive contact having a mating portion adapted for mating with the complementary connector and a connecting portion retained in a rear end of the insulative insert, a conductive shield enclosing the insulative insert;

a cable having a plurality of wires and each wire having a conductive conductor electrically and mechanically connecting with the connecting portion of the contact;

a pair of strong grounding conductors mechanically connected to a pair of sides of the connector and electrically connecting with a grounding trace of the connector so as to enhance an intensity of tension of the cable and a grounding effect.

2. The electrical connector assembly as described in claim 1, wherein the contacts comprises a grounding contact, the assembly further comprises a grounding bar received in the insulative insert of the connector and electrically connecting with the connecting portion of the grounding contact, the pair of grounding conductors are soldered on the grounding bar.

3. The electrical connector assembly as described in claim 2, wherein the shield forms a plurality of resilient tabs electrically and mechanically connecting with the grounding bar.

4. The electrical connector assembly as described in claim 1, wherein the pair of grounding conductors twists around the wires so as to enhance the intensity of tension of the cable.

5. The electrical connector assembly as described in claim 4, further comprising a conductive tape wrapping the wires and the grounding conductors therein, the pair of grounding conductors electrically connects with the conductive tape.

6. The electrical connector assembly as described in claim 1, further comprising an insulative housing which has a base portion and a tongue portion extending forwardly from the base portion, the contact set is received in the base portion and the mating portions of the contacts extend into and are received into the tongue portion adapted for mating with the complementary connector.

7. An electrical connector assembly comprising:

an electrical connector including an insulative housing assembly containing a plurality of contacts therein;

a grounding bar retained in the housing assembly;

a cable including a plurality of micro-coaxial wires having respective front ends retained by the housing assembly, each of said micro-coaxial wires including an inner conductor soldered to the corresponding contact, and an outer grounding conductor mechanically and electrically connected to the grounding bar; and a metal shell enclosing said housing assembly; wherein said cable further includes a pair of grounding wires front ends secured to proximate two opposite ends of the grounding bar and enclosed in the shell wherein said pair of grounding wires are stiffer than said micro-coaxial wires;

wherein said pair of grounding wires are in a tension manner while said micro-axial wires are in a relaxed manner.

8. The connector assembly as described in claim 7, wherein said grounding bar further includes a plurality of forwardly extending fingers contacting selected contacts, respectively.

9. The connector assembly as described in claim 7, wherein said pair of grounding wires endure most pull forces in comparison with said micro-axial wires when a rearward pull force is imposed on the cable.

* * * * *